US010426201B2

(12) United States Patent
DeBusk et al.

(10) Patent No.: US 10,426,201 B2
(45) Date of Patent: Oct. 1, 2019

(54) GARMENT WAISTBAND

(71) Applicant: Wells Hosiery and Apparel, Asheboro, NC (US)

(72) Inventors: Rodney Jay DeBusk, Greensboro, NC (US); James Ray Johnson, Franklinville, NC (US); Salina Jean Davis, Asheboro, NC (US); Robert Charles Nelson, Siler City, NC (US)

(73) Assignee: Wells Hosiery and Apparel, Asheboro, NC (US)

( * ) Notice: Subject to any disclaimer, the term of this patent is extended or adjusted under 35 U.S.C. 154(b) by 66 days.

(21) Appl. No.: 15/837,099

(22) Filed: Dec. 11, 2017

(65) Prior Publication Data

US 2019/0174836 A1 Jun. 13, 2019

(51) Int. Cl.

| | |
|---|---|
| ***A41B 9/04*** | (2006.01) |
| ***A41B 9/14*** | (2006.01) |
| ***A41B 11/14*** | (2006.01) |
| ***A41D 1/06*** | (2006.01) |
| ***D04B 1/24*** | (2006.01) |
| ***D04B 1/18*** | (2006.01) |
| ***A41F 9/02*** | (2006.01) |

(52) U.S. Cl.

CPC ..... *A41B 9/14* (2013.01); *A41B 9/04* (2013.01); *A41B 11/14* (2013.01); *A41D 1/06* (2013.01); *A41F 9/02* (2013.01); *D04B 1/18* (2013.01); *D04B 1/243* (2013.01); *A41B 2500/10* (2013.01); *A41D 2500/10* (2013.01)

(58) Field of Classification Search

CPC .. A41B 9/04; A41B 11/14; A41D 1/06; A41F 9/02; D04B 1/18; D04B 1/243

USPC ..... 2/236, 237, 400–403, 406, 408; 66/170, 66/171, 169 R, 172 E, 176, 178 R

See application file for complete search history.

(56) References Cited

U.S. PATENT DOCUMENTS

| | | | | |
|---|---|---|---|---|
| 3,979,928 | A * | 9/1976 | Atwater | D04B 9/46 66/107 |
| 3,987,650 | A | 10/1976 | Negri | |
| 4,041,736 | A | 8/1977 | Fregeolle | |
| 4,150,554 | A | 4/1979 | Cassidy | |
| 4,445,345 | A | 5/1984 | Bedier | |
| 4,527,403 | A * | 7/1985 | Fullbright | A41B 9/001 2/401 |
| 4,872,324 | A | 10/1989 | Rearwin et al. | |
| 5,280,652 | A | 1/1994 | Davis et al. | |
| 5,787,512 | A | 8/1998 | Knox | |
| 6,276,176 | B1 | 8/2001 | Blakely | |
| 6,516,637 | B1 * | 2/2003 | Faucher | D04B 21/18 66/170 |

(Continued)

*Primary Examiner* — Gloria M Hale
(74) *Attorney, Agent, or Firm* — Fox Rothschild LLP

(57) ABSTRACT

An improved waistband for lower body garments, such as pantyhose, tights, leggings, or underwear. The waistband is knitted as a tube on a circular knitting machine with horizontal courses with respect to the length of the tube. The tube is configured into a continuous loop and seamed. The tube is perpendicularly sewn to the top of the panty portion of the garment to create the waistband such that the knit courses in the waistband align vertically with respect to the length of the garment. The vertical alignment of the courses in the waistband provide comfort and support while resisting the roll down effect that occurs in knitted waistbands having horizontally aligned courses.

6 Claims, 2 Drawing Sheets

(56) References Cited

U.S. PATENT DOCUMENTS

| | | | |
|---|---|---|---|
| 8,661,568 | B1 | 3/2014 | O'Brien |
| 2006/0117806 | A1 | 6/2006 | Cheeseman |
| 2012/0036616 | A1 | 2/2012 | Miyasaka |
| 2015/0157060 | A1 | 6/2015 | Solano et al. |

* cited by examiner

GARMENT WAISTBAND

TECHNOLOGICAL FIELD

The present disclosure is directed towards tights, pantyhose, leggings, underwear, and like garments having a novel waistband construction wherein the waistband is separately knitted as a tube and sewn onto the garment such that the knitted courses of the waistband are vertically aligned with respect to the garment.

BACKGROUND

Throughout the history of women's intimate wear, women have had issues with garments having waistbands, such as on tights, pantyhose, leggings, and underwear. Such issues include the waistband being too tight, not providing enough support, and/or rolling down during use (also known as the "roll over effect"). There have been various prior art attempts to solve these problems such as comfort band technology and sewn-on waistbands that are double plush in nature. However, those prior art attempts have not been successful in overcoming the referenced deficiencies. For example, comfort band technology includes a powerful elastic, single-layer waistband that provides sufficient support, but the compression is so strong that it is uncomfortable to the wearer. Some women complain that it feels like the waistband is "choking" them. Double plush waistbands, on the other hand, are sewn on elastic bands which have an extra layer of textured nylon woven into the elastic to add thickness to the band. However, double plush waistbands are not aesthetically pleasing and do not conform to the wearer's body, thereby resulting in the roll over effect noted above.

Based on the foregoing, there is a need in the art for a waistband construction and manner of making the same that provides support and comfort while minimizing the roll over effect in for garments such as pantyhose, tights, leggings, and underwear.

BRIEF SUMMARY

The following is a non-exhaustive list of examples, which may or may not be claimed, of the subject matter according to the present disclosure. A lower body garment including a panty portion and a waistband that is sewn onto the panty portion. The waistband is knitted on a circular knit machine as a tube having courses in a horizontal direction. The tube is configured into a continuous loop and seamed. The continuous loop is perpendicularly sewn onto the panty portion such that the courses in the waistband are then vertically aligned with respect to a length of the garment. The lower body garment may be pantyhose, tights, leggings, or underwear. The waistband may be knitted of elastomeric yarns.

A method of making a lower body garment is provided including the steps of knitting a tube having a first end and a second end on a circular knit machine with courses in a horizontal direction, configuring the tube into a continuous loop, seaming together the first end and the second end, and perpendicularly sewing the tube onto a panty portion of the garment such that the courses in the waistband are vertically aligned with respect to a length of the garment.

DETAILED DESCRIPTION

Figure 1A:
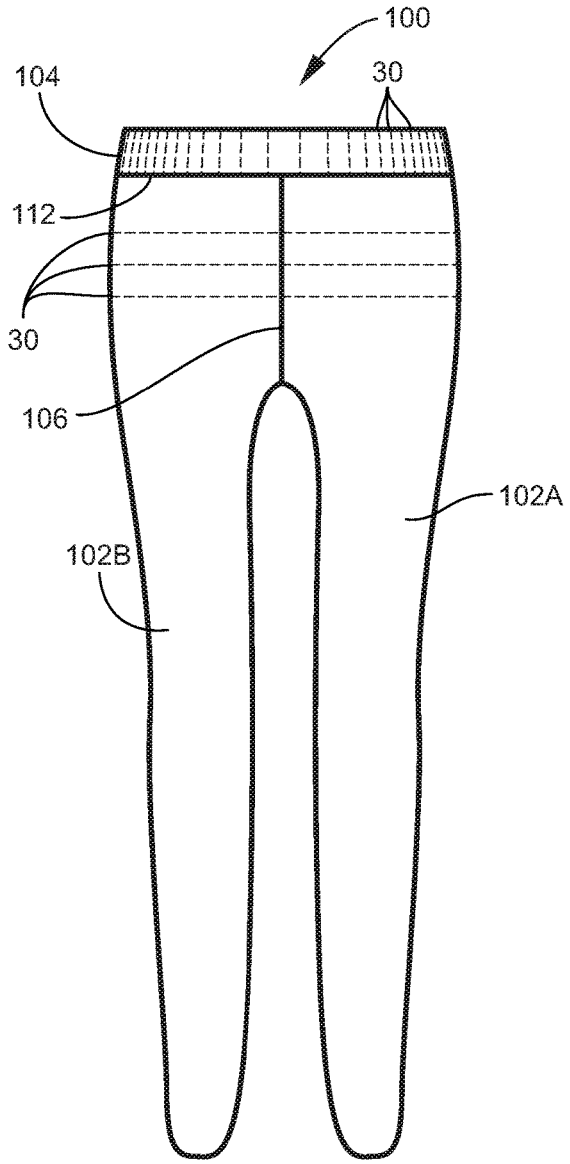
FIG. 1A is a front view of a tights garment in accordance with an example implementation of the present disclosure.

Some implementations of the present disclosure will now be described more fully hereinafter with reference to the accompanying drawings, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Also, something may be shown or described as being to a first, second, third or the like should not be taken to imply a specific order, unless otherwise stated. Further, although reference may be made herein to a number of measures, predetermined thresholds and the like such as dollar amounts, units, percentages and the like, according to which aspects of example implementations may operate; unless stated otherwise, any or all of the measures/predetermined thresholds may be configurable. Like reference numerals refer to like elements throughout.

Figure 1B:
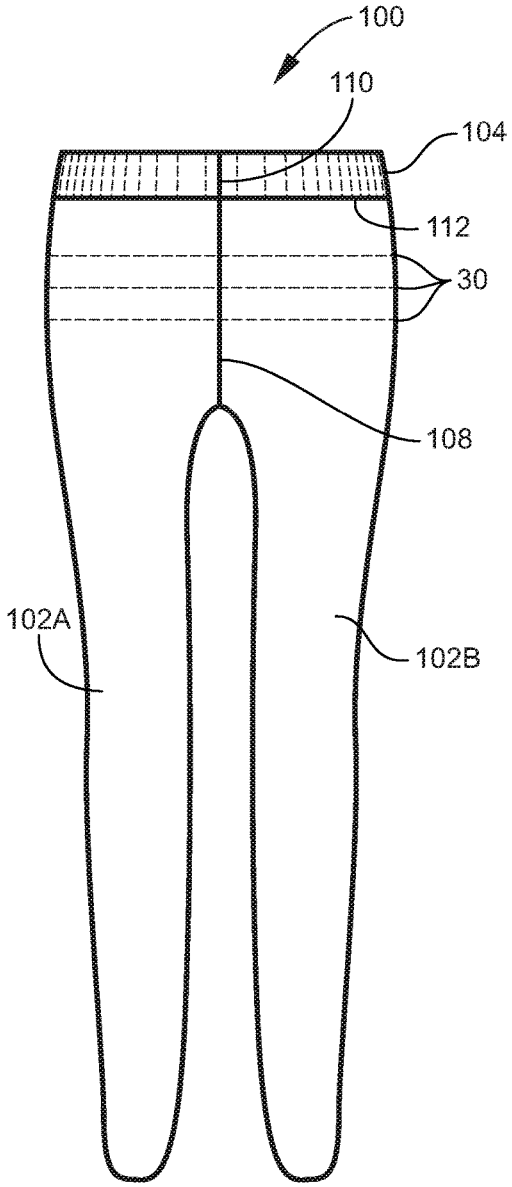
FIG. 1B is a rear view of the tights garment of FIG. 1A in accordance with an example implementation of the present disclosure.
Figure 4:
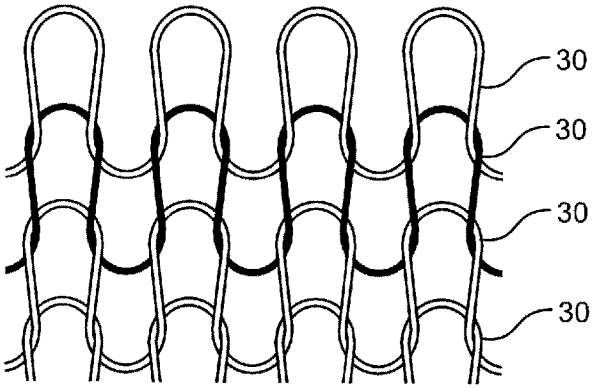
FIG. 4 is a schematic diagram of knit construction having horizontal courses in accordance with an example implementation of the present disclosure.
Figure 2:
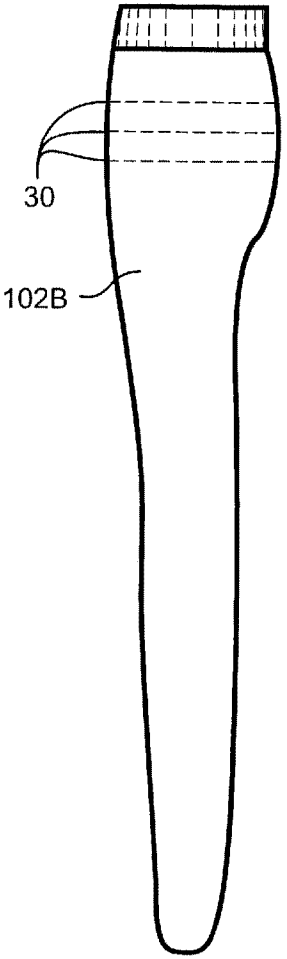
FIG. 2 is a front view of one leg portion of the tights garment of FIGS. 1A and 1B in accordance with an example implementation of the present disclosure.

Referring now to FIGS. 1A-1B, a tights garment 100 is shown having two leg portions 102A, 102B and a waistband 104 in accordance with an example implementation of the disclosure. As shown in FIG. 2, each of the leg portions 102A, 102B is separately knitted on a circular knitting machine in accordance with known methods of construction. Particularly, the nature of a traditional circular knitting machine is such that it knits a tube and the courses 30 run horizontally with respect to the length of the tube, as shown in knit formation diagram of FIG. 4. In traditional tights, leggings, and pantyhose construction, after each leg portion 102A, 102B is knitted, they are sewn together resulting in seams 106, 108 in the panty area of the garment 100.

Figure 3A:
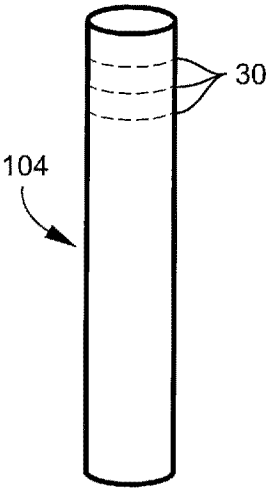
FIG. 3A is a perspective view of a knitted tube in accordance with an example implementation of the present disclosure.
Figure 3B:
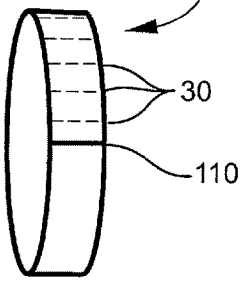
FIG. 3B is a perspective view of the knitted tube of FIG. 3 as configured into a continuous loop in accordance with an example implementation of the present disclosure.

In accordance with example implementations of the present disclosure, the novel waistband 104 for the garment 100 is not knitted onto the garment 100 and is rather separately knitted on a circular knitting machine, which similarly results in a seamless tube construction having courses 30 running in a horizontal direction with respect to the length of the tube, as shown in FIG. 3A. The waistband 104 may be knitted to various lengths to accompany a variety of sizes for the ultimate consumers. Once the desired length of the tube for the waistband 104 has been reached to achieve the desired circumference of the ultimate waistband 104, the tube is cut and sewn together at its ends forming a continuous loop shape with a single overlocked or flat seam 110, as shown in FIG. 3B.

Figure 5:
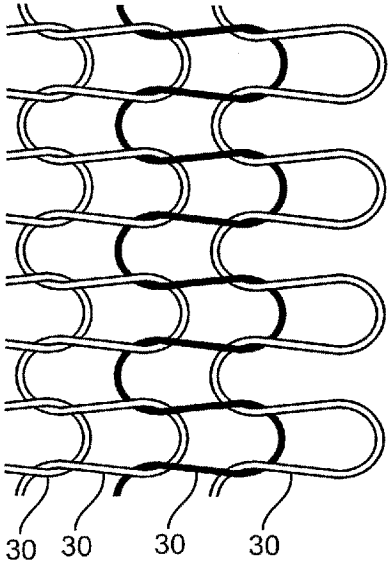
FIG. 5 is a schematic diagram of a knit construction having vertically aligned courses in accordance with an example implementation of the present disclosure.

The finished waistband 104 is added to the seamed leg portions 102A, 102B to complete the garment 100 by first perpendicularly turning the waistband 104 and then seaming 112 it to the leg portions 102A, 102B such that the courses 30 in the waistband 104 align vertically (as shown in FIG. 5) with respect to the length of the garment 100. Specific to the example shown in FIGS. 1A and 1B, the waistband 104 is oriented on the garment 100 such that the courses 30 are aligned vertically, which is perpendicular to the horizontally aligned courses 30 of the leg portions 102A, 102B.

The resulting garment 100 provides unique support and comfort without the waistband tending to roll down as in prior art garments. Specifically, prior art garments having horizontal courses in the waistband have a strong tendency to roll down from the weight of the wearer's body and the pressures that are applied by the wearer's normal activity such as walking, stooping, and bending. This is because the rolling down follows the horizontal knitting construction. In the garment 100 of the present disclosure, however, the orientation of the waistband 104 results in vertically aligned courses 30 that run in contrast to the weight and pressures of the body. Therefore, the waistband 104 resists pressure and contours to the wearer's body without the roll over effect as determined by consumer testing. The waistband 104 holds the garment 100 in place on the wearer's body while resisting slipping and sliding down because of the vertical alignment of the courses 30 of the waistband 104 as sewn into the garment 100.

In yet another aspect of the present disclosure, the waistband 104 is knitted of elastomeric yarns such as Spandex or Lycra having deniers of significant weight, such as 50, as to give a great feel on the wearer's body without being too bulky or noticeable under the wearer's clothes. The denier can be altered to provide varying levels of compression to the waistband 104.

Different examples of the systems and methods disclosed herein include a variety of components, features, and functionalities. It should be understood that the various examples of the systems and methods disclosed herein may include any of the components, features, and functionalities of any of the other examples of systems and methods disclosed herein in any combination, and all of such possibilities are intended to be within the spirit and scope of the present disclosure.

Figure 6:
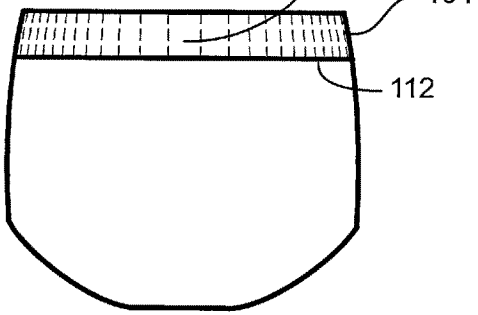
FIG. 6 is a front view of an underwear garment in accordance with an example implementation of the present disclosure.

Many modifications and other implementations of the disclosure set forth herein will come to mind to one skilled in the art to which these disclosures pertain having the benefit of the teachings presented in the foregoing descriptions and the associated drawings. Therefore, it is to be understood that the disclosures are not to be limited to the specific implementations disclosed and that modifications and other implementations are intended to be included within the scope of these disclosures. For example, while the example shown in the Figures herein is that of tights, it should be noted that the present disclosure is not limited to tights in particular. Rather, the garment including the waistband construction of the present disclosure may be various types of intimate wear such as underwear (see FIG. 6), leggings, pantyhose, and the like.

Moreover, although the foregoing descriptions and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

The invention claimed is:

1. A lower body garment comprising:

a panty portion; and a waistband that is sewn onto the panty portion;

wherein the waistband is knitted on a circular knitting machine as a tube having courses in a horizontal direction with respect to a length of the tube, the tube having a first end and a second end;

wherein the first end and second end of the tube are seamed to form a continuous tube; and wherein the continuous tube is perpendicularly sewn onto the panty portion such that the courses in the waistband are vertically aligned with respect to a length of the garment.

2. The lower body garment of claim 1 wherein the garment is selected from the group consisting of pantyhose, tights, leggings, and underwear.

3. The lower body garment of claim 1 wherein the waistband is knitted of elastomeric yarns.

4. A method of making a lower body garment comprising the steps of:

knitting a tube having a first end and a second end on a circular knitting machine with courses in a horizontal direction with respect to a length of the tube;

seaming the first end and the second end to form a continuous tube; and perpendicularly sewing the continuous tube onto a panty portion of the garment such that the courses in the waistband are vertically aligned with respect to a length of the garment.

5. The method of claim 4 wherein the garment is selected from the group consisting of pantyhose, tights, leggings, and underwear.

6. The method of claim 4 further comprising the step of knitting the waistband with elastomeric yarns.

* * * * *